United States Patent [19]

Plummer

[11] Patent Number: 4,958,469

[45] Date of Patent: Sep. 25, 1990

[54] COLLAPSIBLE WINDOW FLANGE APPARATUS

[75] Inventor: David D. Plummer, Hudson, Wis.

[73] Assignee: Andersen Corporation, Bayport, Minn.

[21] Appl. No.: 352,355

[22] Filed: May 16, 1989

[51] Int. Cl.[5] ..... E06B 1/04

[52] U.S. Cl. ..... 52/213

[58] Field of Search ..... 52/213, 216, 217

[56] References Cited

U.S. PATENT DOCUMENTS 3,325,585 6/1967 Brenneman ..... 52/586 X 4,821,472 4/1989 Tix ..... 52/213

FOREIGN PATENT DOCUMENTS 2152991 8/1985 United Kingdom ..... 52/213

*Primary Examiner*—Carl D. Friedman

*Attorney, Agent, or Firm*—Merchant, Gould, Smith, Edell, Welter & Schmidt

[57] ABSTRACT

An improved detachable nailing flange construction for window and door frames is disclosed. The flange configuration allows the flange to be rotated between collapsed and operative extended positions, while retainably attached to the frame. When collapsed, the flange is protected by the frame for shipment and handling. Means are provided for locking the flange into its extended position and for providing a weathertight seal with the frame. The direction of attachment to the frame can be reversed for selectively adjusting the lateral position at which the flange projects from the frame so as to vary the set-back of the frame relative to the wall in which it is to be installed.

28 Claims, 4 Drawing Sheets

COLLAPSIBLE WINDOW FLANGE APPARATUS

FIELD OF THE INVENTION

This invention relates generally to window and door construction, and more particularly to an improved design for a window or door nailing flange that is collapsible against the frame of the unit to facilitate handling and shipping of the window or door assembly.

DESCRIPTION OF THE ART

Window and door assemblies generally include a flange member outwardly extending along the outer periphery of the assembly frame. It will be understood by those skilled in the art that the principles of this invention apply equally well to window and door assembly construction, and in general, to any type of assembly having a frame member set into a rough opening in a wall-like structure that requires a sealing or mounting flange peripherally around its frame. However, for ease of further description hereafter, the invention will only be described with reference to its applicability with "window" assemblies, it being understood that the invention's other applications are intended to be covered by such description.

The flange provides a weathertight seal between the wall in which the window is mounted and the frame of the window. The flange is also used in some applications to directly secure the window assembly in its operative position within the rough opening of the building structure. In other applications, wherein the window assembly may be too heavy to be supported only by the flange, the flange can be used to temporarily hold the assembly in its desired location within the rough opening until the window can be otherwise properly secured to the wall structure.

Such flanges often referred to as "nailing flanges" generally extend around the entire perimeter of the window frame, near the outer edge of the frame. The flange is configured to extend outwardly from the window frame at a lateral position or "depth" along the frame such that its inner surface is secured directly to the underlayment sheathing of an outer wall, and is subsequently covered by the finish siding, brick or other decorative surface of the wall structure, placing the window assembly at the proper "depth" position within the wall opening. The flange often includes preformed or stamped holes longitudinally spaced therealong for nailing purposes.

The type of material from which the flange is constructed varies with the construction application and with the materials from which the window frame assembly is constructed. It is generally desirable that the flange display some degree of flexibility to enable it to conform with the shape irregularities of the wall to which it will be secured, yet it must have sufficient structural rigidity to provide proper support to the window frame structure. While not inclusive of the list of materials that have been used to construct such flanges, various materials such as vinyls, aluminum and various plastics have been used for this purpose.

The flange can either be formed or extruded as an integral extension of the outer portion of the window frame or can be provided as a detachable, removable part of the frame. Obviously, when the flange is formed as an integral part of the frame, it provides its own seal with the frame and requires no additional sealant or weatherstripping to provide the seal function. The primary disadvantage of the integrally formed flange is its vulnerability to damage during shipping and handling of the window assembly Another disadvantage is that the "depth" of the window placement within the wall rough opening cannot be varied since the flange position along the frame is permanently fixed. In such integrally formed flange systems, since the flange forms a part of the overall seal and finish provided by the external frame section, any damage to the flange may extend to the protection system of the frame itself, degrading the window reliability, and in severe cases, requiring replacement of the entire window To safeguard against such possible damage, integral flange systems have required additional packing for shipment and larger packing containers to protect the flange extension, and have required additional handling precautions at the construction site in the unpacking, handling and installation of the window assembly.

To reduce the above problems, more recent window designs have included removable or detachable flange members which include an attachment mechanism at one end thereof, such as a dovetail fastener, that can be longitudinally slid into a cooperatively sized channel on the window frame at the construction site. While significantly reducing the chance for damage to the flange or the seal or finish system of the window frame proper, the detachable flange systems have required lost time at the construction site to install the flange assemblies. Further, since such detachable flange assemblies generally include some type of weatherstrip seal member at their outer edge which cooperatively engages the window frame, if the flange to be installed is of significant length, it can become difficult to longitudinally slide into its receptor channel due to the binding action of the weatherstripping against the frame. Also, careless handling or forcing of the flange into its receptor channel during installation thereof can damage the weatherstrip, thereby reducing reliability of the flange seal.

Accordingly, while the flange designs of the prior art have improved over the years, they still do not provide that combination of features most desirable for a window flange. Such flange should provide the structural rigidity yet flexibility required to required the window in its intended installation. It should provide a weathertight seal between the flange and the window frame. It should not be unduly susceptible to breakage or damage during shipping, handling or installation and should not require additional packing materials for shipping It should be rapidly and easily replaceable if damaged, and if formed as a detachable member, provide minimal damage exposure to any weatherstripping parts thereof during replacement. Any damage inflicted to the flange during shipping, handling, installation or the like, should not extend to the window assembly proper. The flange should provide a degree of flexibility in allowing the window to which it is attached to be mounted at various "depths" or set-back positions within the wall in which the unit is installed. The present invention addresses and satisfies each of the above desired features and functions of a window flange in a manner that satisfies window performance requirements, virtually eliminates additional packing requirements, is user friendly at the construction site and provides design flexibility in installation of the window unit in the wall structure.

SUMMARY OF THE INVENTION

The present invention provides an improved flange design for securing the frame of window and door assemblies to the wall in which the window or door is to be installed. The flange includes means for detachably securing the flange to the frame structure such that it can be readily separated from the frame if required due to damage or desired replacement thereof. The flange is constructed so that it can be directly attached in a snap-fit manner to the outer edge of the window without requiring the flange to be longitudinally fed into a securement groove or slot from one end of the frame. While secured to the window or door frame, the flange can be rotated to a collapsed position so as to generally lie along and in protective engagement with the outer surface of the frame member, and can be rapidly rotated to an operative, extended position relative to the frame at the construction site, with minimal chance for error or damage to the flange or the window frame structure. The flange locks into place in its extended position to provide a weathertight seal between the flange and the frame member to which it is attached, but can be re-rotated to its collapsed position if desired without undo effort and without causing damage to the flange or window assembly.

According to one aspect of the invention, there is provided a detachable flange for a window or door frame of the type which includes a longitudinally extending retainer groove formed within the frame and accessible along its length through a longitudinal access port extending from the outer surface of the frame, comprising:

(a) an elongate generally planar strip-like member having a length which is determined by the longitudinal length of the frame to which the flange is to be attached, and extending between first and second longitudinally extending edges which define therebetween the width of the strip member;

(b) a seat extension extending at an angle to the general plane of the strip member along the longitudinal length of the first edge of the strip and outwardly therefrom to a third edge; and (c) attachment means forming an extension of said seat for detachably securing the seat extension and strip member to a window frame by matingly engaging the retainer groove in the frame through its access port in a manner such that while retainably engaged by said groove, the flange is rotatably movable between operative and collapsed positions. When in its collapsed position, the strip member of the flange lies generally parallel to the outer portion of the frame to which it is attached, and when in its operative position, the strip member projects outwardly from the frame surface such that the seat extension is seated against the frame.

According to a preferred embodiment of the invention, the strip-like member preferably comprises a semi-rigid material and is even more preferably made of vinyl. The flange also includes seal means operatively connected for movement with the flange for providing a weathertight seal between the flange and the frame when the flange is disposed in its operative position. Such seal means preferably includes one or more flexible rib members projecting outwardly from the flange for cooperatively engaging the frame along the length of the rib members when disposed in the operative position Yet another feature of the invention is that the flange is configured for reversible insertion within the groove of the window frame such that the strip-like member can be selectively offset to either side of the groove's access port to selectively adjust the set-back of the window frame to which the flange is attached, relative to the wall in which the window is mounted. The invention provides means for retainably holding the flange into engagement with the frame in either its collapsed or operative position, and for securely locking the flange into sealing engagement with the frame member in its extended or operative position.

According to yet another aspect of the invention, there is provided a detachable flange for a window or door frame, comprising:

(a) primary flange body means having a broad generally planar surface for spanning the space between the outside surface of the window or door frame and the external sheathing of a wall in which the frame is mounted; and (b) attachment means forming an operative extension of said primary flange body means for cooperatively detachably engaging said frame such that said flange body means is rotatable between extended and collapsed positions.

According to this aspect of the invention, the frame to which the flange is attached is characterized by receptor means peripherally disposed along the outwardly oriented portion of the frame, and the flange includes means for detachably engaging the receptor means. According to a preferred embodiment of the invention, the receptor means includes a groove and the fastener means includes male fastener means for cooperatively engaging the groove.

According to yet another aspect of the invention, there is provided a window assembly, comprising:

(a) a frame defining an outer periphery of a window and being configured for attachment in a wall; the frame including first attachment means peripherally extending along an outer edge of the frame for mounting a flange extension thereto;

(b) at least one sash member mounted in and carried by the frame; and (c) a detachable flange for peripherally mounting to said frame comprising:

(i) primary flange body means having a broad generally planar surface for extending between the outer edge of the window frame and a surface of said wall; and (ii) attachment means forming an operative extension of the primary flange body means for cooperatively detachably engaging the frame first attachment means such that the primary flange body means is rotatable between extended and collapsed positions when the first and the second attachment means are engaged.

While the invention will be described with reference to a preferred embodiment thereof which illustrates a flange construction which cooperatively engages a groove formed within the frame, those skilled in the art will readily appreciate that the concepts of this invention are not limited to such an attachment configuration. For example, other forms of attachment means such as those including a portion which extend from or are extruded from the frame itself could be used Further, while the invention will be described with reference to preferred materials for forming the flange and the seal members thereof, it will be understood that the invention is not limited to the use of such materials. It will also be understood by those skilled in the art that while a particular configuration of flange extensions and associated rib members will be used to describe a preferred embodiment of the invention, the invention is not limited to the specifics of such construction but that other design configurations providing the retainable attachment and rotatable features of the flange could be constructed which fall within the broad spirit and scope of this invention. These and other variations of the invention will become apparent to those skilled in the art upon a more detailed description of the invention.

BRIEF DESCRIPTION OF THE DRAWING

Referring to the Drawing wherein like numerals are used to designate like parts throughout the several views.

DESCRIPTION OF THE PREFERRED EMBODIMENT

Figure 1:
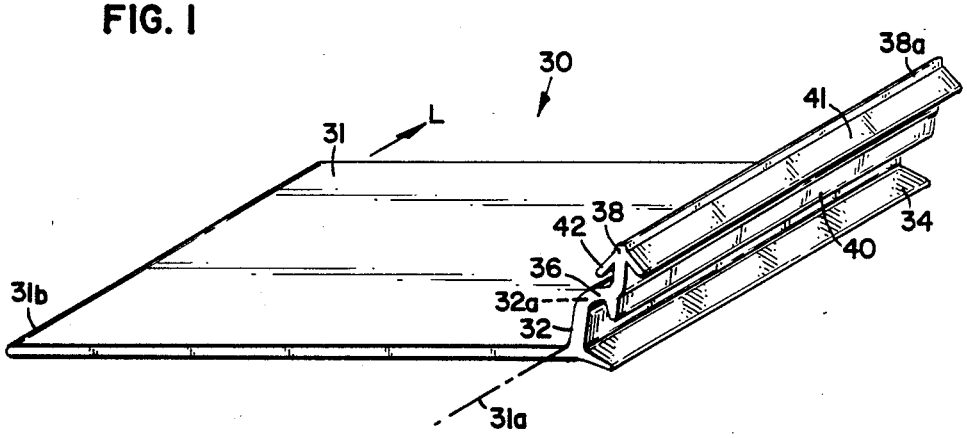
FIG. 1 is a perspective view taken from the top and one end of a portion of a flange member constructed according to,,the principles of this invention.

Referring to the Figures, a portion of a preferred embodiment configuration of a detachable flange constructed according to the principles of this invention is illustrated at 30 in FIG. 1. The flange has a generally planar strip-like body portion generally designated at 31 extending in a "width" direction between first and second longitudinally extending edges 31*a* and 31*b* respectively. The "length" of the primary body portion 31 of the flange extends in the direction designated as "L" in FIG. 1, and is dictated by the length of the window or door frame member to which the flange is to be secured. In most applications, a nailing flange such as illustrated at 30 would be secured around the entire peripheral outer edge of a window or door frame, as is well-known in the art.

The first edge 31*a* of the primary flange body portion 31 continuously extends outwardly from the general plane of the primary body 31 to form an elongate seat extension 32. In the preferred embodiment, the seat extension 32 forms an angle of approximately 90 degrees with the general plane of the primary body portion 31 of the flange. As will become apparent upon a more detailed description of the invention, it will be understood that the angle that such a seat extension 32 (if one is employed at all) forms with the primary body portion 31 is dictated by the angular configuration of the outer surface of the frame member to which the flange is attached The seat extension 32 extends in continuous manner in the preferred embodiment, along the longitudinal length of the first edge of the primary body portion 31 and outwardly therefrom to a third longitudinal edge, generally designated at 32*a*. A first tapered rib member 34 is connected to and longitudinally extends the length of the flange at the juncture of the seat extension 32 with the first edge of the flange primary body portion 31. The thickness of the rib member 34 tapers downwardly from a thickest dimension at the first edge 31*a* to a much thinner thickness at its distal end, and serves as a flexible weatherstrip member, as hereinafter described in more detail.

That portion of the flange 30 connected to and extending from the third edge 32*a* forms a structure for attaching or securing the flange to a frame member. In the preferred embodiment, the attachment structure includes a first extension portion 36 forming a continuous extension of the seat extension 32 at the third edge 32*a*, which lies in a plane generally parallel to that of the primary body portion 31. The first extension portion 36 continuously connects to a slot engagement portion 38 (hereinafter described in more detail) which, in the preferred embodiment, lies in a plane generally parallel to that in which the seat extension 32 lies. The slot engagement portion 38 of the flange terminates at a fourth longitudinally extending edge 38*a* of the flange 30.

A second tapered rib member 40 projects downwardly from the juncture of the first extension portion 36 and the slot engagement portion 38 of the attachment means and is in the preferred embodiment, constructed of the same flexible material as the first rib member 34. The second rib member 40 lies generally in the same plane as the slot engagement portion 38, however, projects in an opposite direction therefrom. Third and fourth tapered rib members longitudinally project outwardly, and at oblique angles thereto, from the slot engagement portion 38 adjacent its fourth edge 38*a*. The third and fourth tapered rib members 41 and 42 are also, in the preferred embodiment, constructed of the same flexible material as rib members 34 and 40. In the preferred embodiment, the length of projection of the first rib member 34 is two or more times that of the second, third and fourth rib members 40, 41 and 42 respectively. In the preferred embodiment, the third and fourth rib members 41 and 42 form an included angle with the slot engagement extension 38 of less than 90 degrees, and preferably in the range of 45°–90°.

In the preferred embodiment, the primary body portion 31, the seat extension 32, the first extension portion 36 and the slot engagement portion 38 of the flange are all continuously formed from the same material, preferably by means of a single extrusion process. In the preferred embodiment, the thickness of all of these portions is generally the same and is of sufficient thickness to provide some flexibility to the flange However, the flange has sufficient rigidity to enable the flange to be used to support the weight of the window or door structure within a rough opening of a wall, when used as a nailing flange to secure the window or door structure to the wall sheathing. In the preferred embodiment, the 31, 32, 36 and 38 portions of the flange are constructed of a semirigid vinyl material, whereas the 34, 40, 41 and 42 tapered rib member portions of the flange are constructed of a more flexible dual durometer vinyl material.

Figure 2:
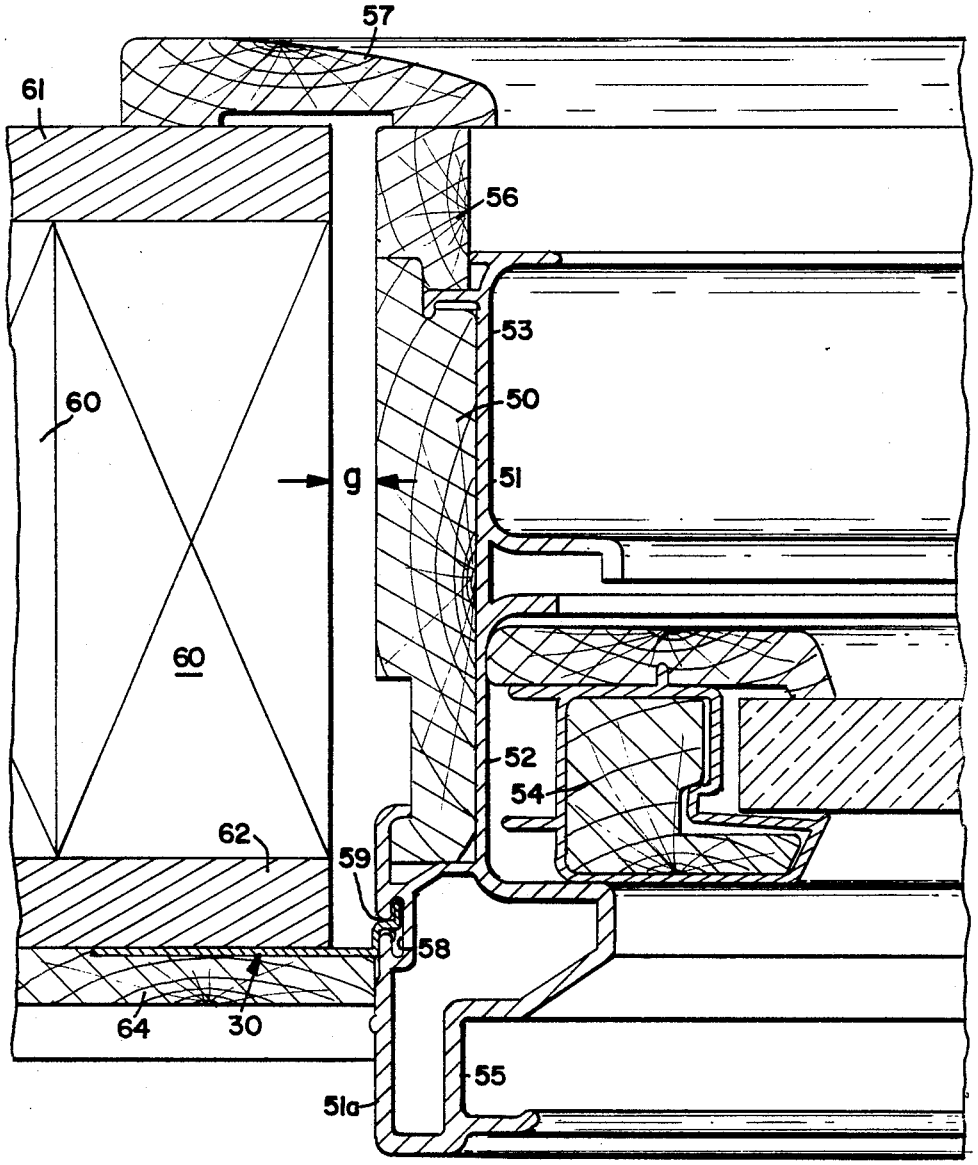
FIG. 2 is a cross-sectional view of a window frame of a typical window assembly with which the present invention could be employed, illustrating the window frame as operatively installed in a wall and incorporating the flange member of FIG. 1.

In order to better understand the inventive properties of the above-described flange, it may help to visualize the flange as it typically would be employed with a window or door frame. Such a typical application is illustrated in FIG. 2. Referring thereto, a cross-section of a side jamb of a window frame installed within a vertical wall is illustrated. The window frame has a wooden frame core 50 covered by and connected to an extruded jamb overlay 51 which is extruded to form the various desired shapes and contours of the jamb construction. The jamb overlay is preferably formed from a fiber reinforced plastic material. In the illustration depicted in FIG. 2, the jamb 51 is configured to form a pair of channels 52 and 53 for slidably accommodating a pair of window sashes of a sliding or gliding window, one of such sashes being generally illustrated at 54. The lower portion of the jamb 51 (as illustrated in FIG. 2) represents the "outside" surface of the frame, and forms a groove portion 55 for retainably holding an insect screen (not illustrated). The opposite edge of the jamb includes an extension jamb 56 (well-known in the art) to which is secured an inner trim board 57 which trims out the window frame on the inside wall of the structure in which the window is mounted. The stud members forming the sides of the rough opening into which the window is inserted are generally illustrated at 60. In a typical construction, sheetrock or other inside sheathing material 61 forms the inner wall of the structure and an insulator or plywood sheathing 62 is secured to the outer surface of the studs 60 to form the outer primary sheathing of the wall structure.

The outwardly directed edge 51*a* of the jamb extrusion 51 forms a recessed retainer groove 58 longitudinally extending along the length of the jamb and typically around the entire perimeter of the window or door frame. The retainer groove 58 has, in the preferred embodiment, a pair of lobes laterally extending outwardly from either side of an access port 59 which longitudinally extends along the jamb and provides access into the retainer groove through the outer surface 51*a* of the jamb 51.

The flange 30 is illustrated in FIG. 2 as operatively engaged within the retainer groove 58 of the window frame and as positioned in its extended or operative position (hereinafter described in more detail). When disposed in such extended or operative position, the primary body portion 31 of the flange bridges any gap or space (g) between the window frame and the wall sheathing 62 and cooperatively engages the outer surface of the sheathing 62 as illustrated in FIG. 2, to enable the window frame and parts of the window assembly secured thereto to be operatively positioned within the rough opening of the wall and mounted to the sheathing by nailing or otherwise securing the primary body portion 31 of the flange to the sheathing and underlying studs. Once the window has been properly installed within the rough opening, siding or other appropriate external facing material 64 is applied over the sheathing 62 and covers the flange 30, as illustrated in FIG. 2. As illustrated in FIG. 2, for most applications, it is desirable that the primary body portion 31 of the flange 30 extend outwardly from the outer edge of the window frame so as to lie generally planar with the outer sheathing 62 of the wall. For a side jamb of a window or door frame such as illustrated in FIG. 2, the outer edge of the jamb is generally configured to lie perpendicular with the wall; therefore, in such applications it is desirable that the primary body portion of the flange 30 extend generally perpendicularly outward from the back outer side of the jamb frame, as illustrated in FIG. 2. In other applications such as for that of a window sill, which is generally disposed in an inclined relationship with respect to the outer wall surface, the design of the flange may require altering so as to cause the primary body portion 31 of the flange to project outwardly from the sill frame at an oblique angle. Alternatively, that portion of the sill to which the flange is to be attached could be angled relative to the lower surface of the sill so as to itself lie perpendicular to the outer wall surface. These considerations are wellknown to those skilled in the art and will not be belabored herein.

Referring to the remaining Figures of the Drawing, for continuity and ease of further description, the same frame jamb structure as illustrated in the example of FIG. 2 will be used to illustrate the various operative features of the present invention. Accordingly, in FIGS. 3–7, only that outermost portion of the frame and jamb assembly of FIG. 2 which mounts the flange 30 is illustrated in enlarged cross-sectional view.

Figure 3:
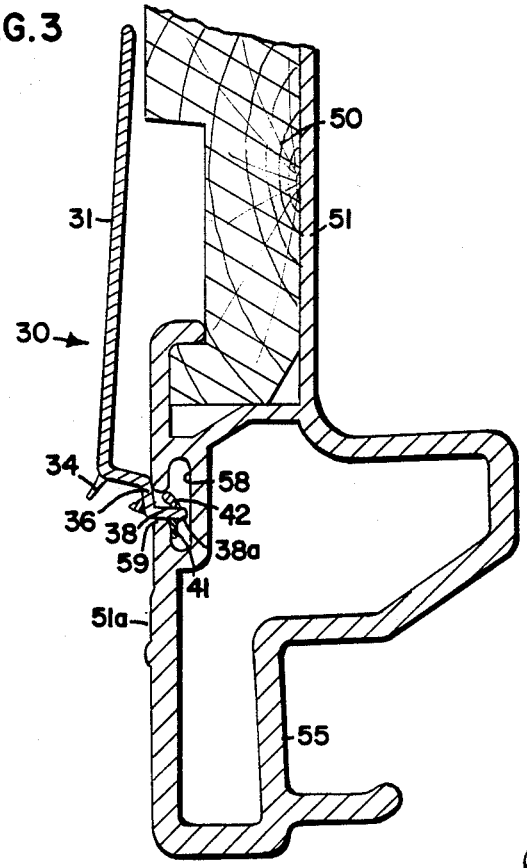
FIG. 3 is an enlarged cross-sectional view of a portion of the window frame of FIG. 2 illustrating the flange member of FIG. 1 attached to the frame in a collapsed position.

Referring to FIG. 3, the flange 30 is illustrated as it would appear retainably engaged by the retaining groove 58, in a first insertion position relative to the frame. As illustrated in FIG. 3, the flange is shown in its "collapsed" position with the primary body portion 31 of the flange rotated into engagement or generally parallel position relative to the frame. In such collapsed position, the flange is protected from cracking or other abuse that it might otherwise sustain if it were projecting outwardly from the frame during shipping or handling of the window or door unit at a construction site. Further, such feature allows the window or door unit to be shipped with the flange 30 preattached to the window frame, as illustrated in FIG. 3, avoiding the necessity of "assembling" the flange to the window at the construction site and avoiding possible error in such assembly or damage to the flange as a result of improper installation thereof by unskilled or careless installers.

In the preferred embodiment, the flange 30 is secured to the frame by aligning the fourth edge 38*a* of the flange with the access port 59 to the retainer groove 58 and by applying pressure to the flange so as to cause the slot engagement portion 38 of the flange and the third and fourth rib members 41 and 42 to slide through the access port 59 and into the cavity of the retainer groove 58. As the slot engagement portion 38 is urged into the retainer groove 58, the third and fourth rib members 41 and 42 respectively will deform, bending downward into engagement with the opposite surfaces of the slot engagement portion 38 to which they are attached, allowing the composite structure including the slot engagement portion 38 and the third and fourth rib members 41 and 42 to simultaneously press through the access port 59. The width of the access port 59 (as viewed in FIG. 3) is slightly less than the combined thicknesses of the slot engagement portion 38 and the third and fourth rib members 41 and 42 when collapsed against the slot engagement portion, such that some deformation of the third and fourth rib members by the opposed faces defining the access port 59 is required in order to insert the flange assembly into the retainer groove 58 as illustrated in FIG. 3. The insertion length dimension (as illustrated in FIG. 3) of the slot engagement portion 38 and the cross-sectional extension lengths of the third and fourth rib members 41 and 42 are such that the slot engagement portion 38 can be inserted far enough into the retaining groove 58 without engaging the "bottom" of the groove and such that the distal edges of the third and fourth rib members 41 and 42 will clear the inner wall surface of the retainer groove adjacent the access port, enabling the rib members to resume their extended positions as illustrated in FIG. 1. When the ribs 41 and 42 extend within the groove, they act as hook members to hold the slot engagement portion 38 within the retaining groove, thereby fastening the entire flange assembly 30 to the frame in the collapsed position as illustrated in FIG. 3. The flange can be detached from the retaining groove 58 by forcibly pulling on the flange so as to cause the slot engagement portion 38 to move in a withdrawal direction from the groove. However, such withdrawal action requires significantly greater force than the insertion action due to the fact that the third and fourth rib members 41 and 42 will be required in such action to bend against the direction of their normal bias as illustrated in FIG. 1. In the preferred embodiment, when the flange is attached to the frame in its collapsed position as illustrated in FIG. 3, the rib members 41 and 42 hold the flange in such collapsed position by drawing the slot engagement portion 38 into the retaining groove until the lower surface of the first extension portion 36 engages the outer surface of the jamb surface 51*a* adjacent the access port 59.

Figure 4:
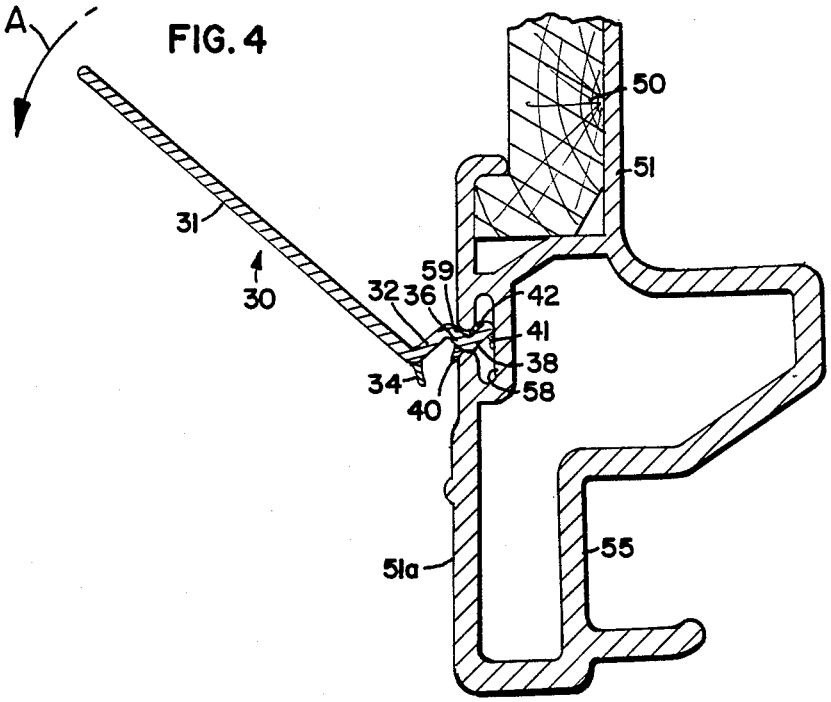
FIG. 4 is an enlarged cross-sectional view of the portion of the window frame of FIG. 3 illustrating the flange member as attached to the frame in FIG. 3 but rotated in the counterclockwise direction approximately 45 degrees from the FIG. 3 illustration.
Figure 5:
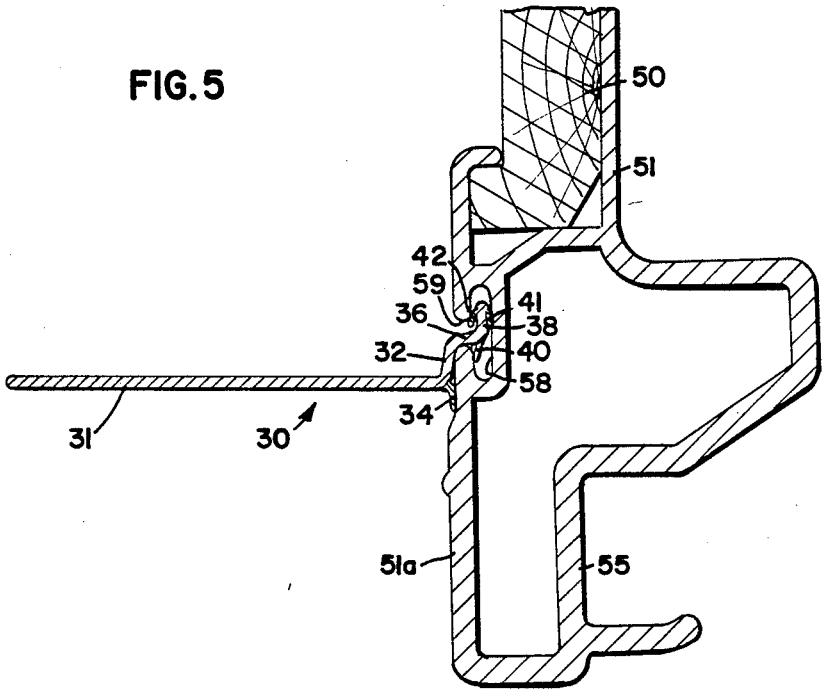
FIG. 5 is an enlarged cross-sectional view of a portion of a window frame illustrating the flange member as attached to the frame in FIGS. 3 and 4, but rotated into a fully operative position relative to the frame.

When it is desired to move the flange 30 to an operative position at the construction site, force is applied to the primary body portion 31 of the flange in the direction identified as "A" in FIG. 4 so as to rotate the flange in the counterclockwise direction as viewed in FIG. 4. As the flange is rotated, the slot engagement portion 38 will be pivoted as urged by the access port jaws, toward engagement with the upper lobe portion of the retaining groove 58. The fourth rib member 42 will compress against the face of the slot engagement portion 38 to enable such rotation to proceed, and the fourth edge 38*a* of the slot engagement portion 38 will ride in cam-like manner against the lower surface of the retaining groove 58. At approximately a 45 degree rotation angle, as generally illustrated in FIG. 4, the second rib member 40 will engage the outer edge 51*a* of the jamb 51. Further counterclockwise rotation will cause the second rib member 40 to deform against the lower surface of the first extension portion 36 and to be carried by the slot engagement portion 38 through the access port 59 and into the inner cavity of the retainer groove 58, as illustrated in FIG. 5. Simultaneously, the first extension portion 36 of the retaining means will be drawn into the access port 59 as the fourth rib member 42 compresses against the lower surface of the retaining groove 58. Rotation of the flange will continue in this manner until the seat extension 32 comes into resting engagement with the outer edge 51*a* of the jamb 51 as illustrated in FIG. 5, at which position the rib member 40 will snap into its freely extended position.

The illustration of FIG. 5 depicts the flange in its fully extended operative position relative to the jamb 51. The flange is held in the operative position by the slot engagement portion 38 within the upper lobe of the retainer groove 58 as compressed therein by the third and fourth rib members 41 and 42 and by the second rib member 40 which holds the first extension portion 36 of the flange in the access port and the seat extension 32 into engagement with the outer surface 51*a* of the jamb 51. The combined action of these portions of the flange "lock" the flange into its operative position as illustrated in FIG. 5. During the rotation process, the first rib member 34 also engages the outer surface 51*a* of the jamb 51 and slidably extends therealong as illustrated in FIG. 5, forming a weathertight seal between the flange and the outer surface 51*a*. The compressed rib members 41 and 42 as well as the second rib member 40 further enhance the seal between the flange and the frame.

Figure 7:
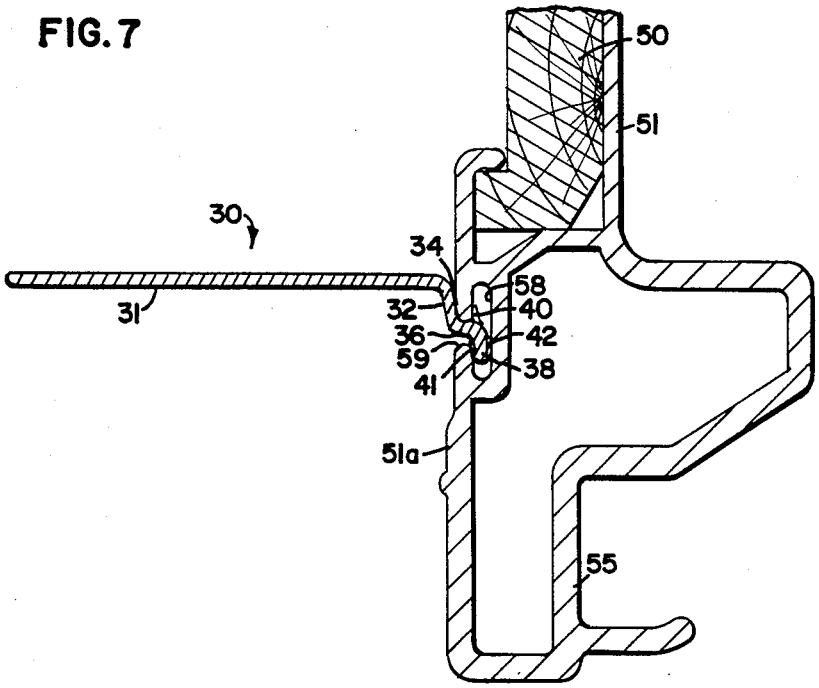
FIG. 7 is an enlarged cross-sectional view of a portion of a window frame illustrating the flange member as mounted to the frame in FIG. 6 but rotated to a fully operative position relative to the frame.

As illustrated in FIG. 5, the length of the seat extension 32, as measured between the first edge 31*a* and the third edge 32*a* (see FIG. 1) determines, for a given position of the retainer groove 58, the set-back position of the window frame relative to the outer surface of the wall. The double-lobed nature of the retainer groove 58 permits the flange 30 to be attached to the frame in a second insertion position opposite to that illustrated in FIG. 5. The second insertion position of the flange is illustrated in FIG. 7. Comparing FIG. 5 with FIG. 7, it will be noted that the primary body portion 31 of the flange is set back significantly further along the jamb in FIG. 7 due to the "reversed" position of the seat extension 32 relative to the jamb. When the flange is attached to the jamb in the second insertion position as illustrated in FIG. 7, the window jamb set-back is significantly less than that of the FIG. 5 configuration. This feature enables the same window jamb construction to be used for applications requiring different set-back requirements, simply by reversing the insertion position of the flange or by selecting an appropriate flange having the seat extension 32 dimension appropriate for the desired application.

Figure 6:
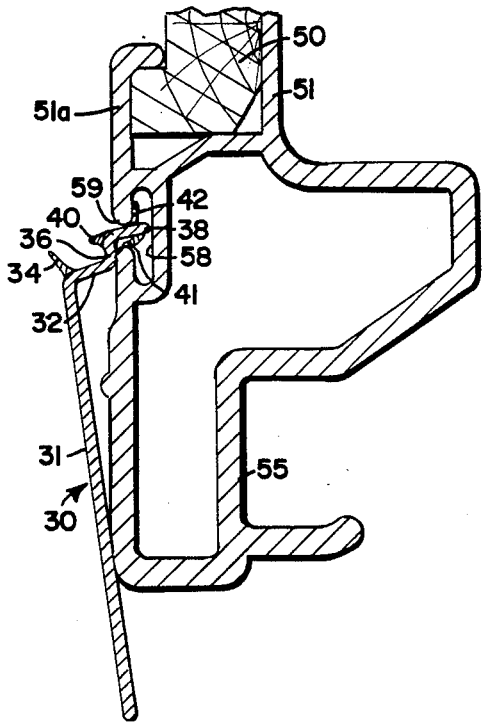
FIG. 6 is an enlarged cross-sectional view of a position of a window frame illustrating the flange member of FIG. 1 attached to the frame in a collapsed position opposite to t position illustrated in FIG. 3.

FIGS. 6 and 7 illustrate respectively the collapsed and the fully extended positions of the flange 30 relative to the window jamb 51 for the second insertion position described above. Referring to FIG. 6, the general principles of insertion and operation are the same but represent a mirror image of those previously described with respect to FIGS. 3 and 4, with the flange being rotated in a clockwise direction from its collapsed position to its fully extended position as illustrated in FIG. 7. As the flange is rotated in the clockwise direction, the slot engagement portion 38 will be rotated into sliding engagement with the bottom surface of the retainer groove 58 and will be directed toward the bottom lobe portion of the retainer groove, as illustrated in FIG. 7. The weathertight seal between the flange and the window jamb is still provided by means of the rib members 34, 40, 41 and 42. In the second insertion position of the flange as illustrated in FIG. 7, however, the third and fourth rib members 41 and 42 (as opposed to the first rib member 34) provide the initial seal barrier for outside air entering the access port 59.

When the flange 31 is rotated to its extended or operative position as illustrated in FIGS. 5 and 7, the flange is "locked" in that position by the combined action of the rib members and the attachment means and seat portions of the engaged end portion of the flange. Such locking action, besides maintaining the extended nature of the flange relative to the jamb, provides sufficient frictional force between the flange and the retaining groove 58 to prevent easy sliding motion of the flange within the retainer groove. Therefore, once rotated to its extended position, the flange acts as an integral extension of the window or door frame as though it were integrally formed as a part of the frame itself, enabling the window or door frame to be securely fastened to the wall of the structure in which it is to be installed.

While the above-described flange structure as cooperating with the retainer groove provides a locking feature, such locking feature can be reversed without damaging the flange by applying appropriate unlocking pressure to the primary body portion 31 of the flange (in a direction opposite to that of "A" in FIG. 4) so as to disengage the second rib member 40 from the retainer groove 58 and rotate the primary flange body portion 31 back into its collapsed position.

While a specific embodiment of the invention has been disclosed, it is to be understood that such disclosure has been merely for the purpose of illustration and that the invention is not to be limited in any manner thereby. Various modifications of this invention will be apparent to those skilled in the art in view of the foregoing example. The scope of the invention is to be limited only by the appended claims.

What is claimed is:

1. A detachable flange for a window or door frame of the type having a longitudinally extending retainer groove formed below an outer surface of the frame and accessible along its length through a longitudinal access port extending from the outer surface of the frame, comprising:

(a) an elongate generally planar strip member having a length as determined by the longitudinal length of the frame to which the flange is to be attached and first and second longitudinally extending edges defining therebetween the width of said strip member;

(b) a seat extension extending at an angle to the general plane of said strip member and connected thereto along the longitudinal length of the first edge of said strip member, said seat extension extending between said strip member and a third edge;

(c) attachment means forming an extension of said seat extension for detachably securing said seat extension and strip member to a window frame, said attachment means being sized and configured to matingly engage the retainer groove through the access port in a manner such that while retainably engaged by said groove, said strip member and seat extension are rotatably movable between operative and collapsed positions, when in said collapsed position said strip member lying generally parallel to that portion of the frame to which it is attached when in said operative position, said strip member projecting outwardly from said frame with said seat extension being seated against said frame; and (d) wherein said strip member and said seat extension are configured such that their orientation relative to one another does not change in operative use.

2. A detachable flange as recited in claim 1, wherein said strip-like member comprises a semirigid material.

3. A detachable flange as recited in claim 2, wherein said strip-like member is made of vinyl.

4. A detachable flange as recited in claim 1, wherein said flange includes seal means operatively connected for movement with said flange for providing a weathertight seal between said flange and the frame when said flange is disposed in said operative position.

5. A detachable flange as recited in claim 4, wherein said seal means includes at least one flexible rib member extending outwardly from said flange for cooperatively engaging said frame along its length when said flange is disposed in said operative position.

6. A detachable flange as recited in claim 5, wherein said seal means includes a plurality of said flexible rib members.

7. A detachable flange as recited in claim 1, wherein when said flange is positioned in said operative position said seat extension offsets the general plane of said strip-like member from alignment with the longitudinal access port to the retainer groove and wherein said attachment means includes means for detachably mounting said flange to the frame such that said strip-like member can be selectively offset to either side of said access port.

8. A detachable flange as recited in claim 1, wherein said angle of connection of said seat extension to the general plane of said strip-like member is about 90 degrees.

9. A detachable flange as recited in claim 1, wherein said attachment means comprises:

(a) a first extension portion operatively connected to and extending from said third edge of said seat extension; and (b) a retainer member connected to said first extension and configured for ease of insertion into said groove through said access port but for inhibiting removal thereof through said access port once inserted within said groove

10. A detachable flange as recited in claim 9, wherein said strip-like member and said first extension of said attachment means lie in planes generally parallel to one another.

11. A detachable flange as recited in claim 9, wherein said retainer member extends generally at a right angle to said first extension portion.

12. A detachable flange as recited in claim 9, wherein said retainer member includes at least one directionally oriented flexible catch member which acts as a hook to resist withdrawal of said retainer member from said groove.

13. A detachable flange as recited in claim 1, wherein said strip member, said seat extension, and said attachment means are continuously integrally formed from a semirigid material.

14. A detachable flange for a window or door frame comprising:

(a) primary flange body means having a broad generally planar surface for spanning the space between the outside surface of a window or door frame and the external sheathing of a wall in which the frame is mounted; and (b) attachment means forming an operative extension of said primary flange body means for cooperatively detachably engaging said frame such that said flange body means is rotatable relative to said frame between extended and collapsed positions, said primary flange body means and said attachment means being configured such that their orientation relative to one another does not change in operative use.

15. The flange as recited in claim 14, wherein said frame to which said flange is to be attached is characterized by receptor means peripherally disposed along the outwardly oriented portion of said frame, and wherein said attachment means includes means for detachably engaging said receptor means.

16. The flange as recited in claim 15, wherein said receptor means includes a groove, and wherein said flange means includes male fastener means for cooperatively engaging said groove.

17. The flange as recited in claim 15, further including locking means for retainably holding and maintaining said flange in said operative position once rotated thereto.

18. The flange as recited in claim 14, further including seal means operatively connected for movement with said flange body for providing a weathertight seal between said flange and said frame when said flange is disposed in said extended position.

19. A detachable flange as recited in claim 14, wherein said primary flange body means and said attachment means are continuously integrally formed from a semirigid material.

20. A window assembly, comprising:

(a) a frame defining an outer periphery of a window, said frame being configured for attachment in a wall and having first attachment means peripherally extending along an outer edge thereof for mounting a flange extension to said outer frame edge;

(b) at least one sash member mounted in and carried by said frame; and (c) a detachable flange for peripherally mounting to said frame, comprising:

(i) primary flange body means having a broad generally planar surface, for extending between the outer edge of said window frame and a surface of said wall; and (ii) second attachment means forming an operative extension of said primary flange body means for cooperatively detachably engaging said frame and first attachment means such that said primary flange body means is rotatable relative to said frame between extended and collapsed positions when said first and said second attachment means are engaged, said primary flange body means and said second attachment means being configured such that their orientation relative to one another does not change in operative use.

21. A window assembly as recited in claim 20, further including locking means for retainably holding and maintaining said detachable flange in said extended position, once rotated thereto.

22. A window assembly as recited in claim 20, further including seal means operatively connected for movement with said primary flange body for producing a weathertight seal between said flange and said frame when said flange is disposed in said extended position.

23. A window assembly as recited in claim 20, including means for adjusting the lateral position of said primary flange body relative to said first attachment means of said frame, whereby the position relative to the width of said frame at which said primary flange body projects when disposed in said extended position can be selectively varied.

24. An extruded profile of substantially uniform cross-section, designed as a flange for a window or door frame of a type having a groove, which is defined by structure that is generally C-shaped, comprising:

(a) a first lip extending laterally across said groove when the flange is in a collapsed position, and extending longitudinally within said groove, resting against an outer wall of said groove, when the flange is in an operative position;

(b) a second lip lying in a plane substantially parallel to that of said first lip extending substantially perpendicular from the frame outside said groove when the flange is in said collapsed position, and extending substantially parallel to the frame, resting against an outer wall of the frame, when the flange is in an operative position;

(c) a segment extending substantially perpendicularly between and integrally connecting said first lip and said second lip; and (d) an elongate portion extending from and substantially perpendicular to said second lip, said elongate portion extending substantially parallel to the frame, resting against an outer wall of the frame, when the flange is in said collapsed position, and extending substantially perpendicular outward from the frame when the flange is in said operative position.

25. An extruded profile according to claim 24, further comprising means, connected to said first lip, for sealingly engaging said first lip against said outer wall of said groove when the flange is in said operative position.

26. An extended profile according to claim 24, further comprising means, connected to said second lip, for sealingly engaging said second lip against said outer wall of the frame when the flange is in said operative position.

27. An extruded profile according to claim 24, further comprising means, connected to said segment, for resiliently maintaining the flange respectively in said collapsed position or in said operative position.

28. An extruded profile according to claim 24, further comprising means, connected to said first lip, for resiliently retaining said first lip within said groove.

* * * * *